US006642459B2

(12) United States Patent
Chou et al.

(10) Patent No.: US 6,642,459 B2
(45) Date of Patent: Nov. 4, 2003

(54) SWITCH

(75) Inventors: Chin-Wen Chou, Hsin-Tien (TW); Tsui-Jung Su, Hsin-Tien (TW); King-Long Lee, Hsin-Tien (TW)

(73) Assignee: Shin Jiuh Corp., Taipei (TW)

( * ) Notice: Subject to any disclaimer, the term of this patent is extended or adjusted under 35 U.S.C. 154(b) by 0 days.

(21) Appl. No.: 10/044,971

(22) Filed: Jan. 15, 2002

(65) Prior Publication Data

US 2003/0132089 A1 Jul. 17, 2003

(51) Int. Cl.[7] ..... H01H 19/10

(52) U.S. Cl. ..... 200/11 TW; 200/339; 200/11 R; 200/11 G; 200/11 J; 200/11 K

(58) Field of Search ..... 200/11 TW, 339, 200/6 R, 43.13, 43.18, 50.35, 50.36, 4, 11 R, 11 G, 11 J, 11 K, 564, 570, 571, 336

(56) References Cited

U.S. PATENT DOCUMENTS 3,703,613 A * 11/1972 Abel ..... 200/11 TW
4,647,732 A * 3/1987 Yamanaka et al. ..... 200/11 TW

* cited by examiner

*Primary Examiner*—Karl D. Easthom
*Assistant Examiner*—Jennifer A. Poker
(74) *Attorney, Agent, or Firm*—Birch, Stewart, Kolasch & Birch, LLP

(57) ABSTRACT

An improved switch consists of a seat, a button key, a first elastic element, a second elastic element, and a cap. The switch offers users pushing or depressing operations to control switching or selection of various function and may give users more touching sense during operations.

6 Claims, 5 Drawing Sheets

SWITCH

FIELD OF THE INVENTION

The present invention relates to an improved switch and particularly a switch allowable for pushing and pressing operations.

BACKGROUND OF THE INVENTION

Most known mobile phones have pushbuttons for controlling cursor directions. These pushbuttons may be used to switch or select various function displayed on the viewing window of the mobile phones. Users can easily operate various function appeared on the viewing window on the mobile phones.

The forgoing pushbuttons consist of up, down, left and right buttons. Depressing the up, down, left or right buttons, the cursor will be moved to up, down, left or right direction. In the mean time, the item shown on the display screen at the cursor position will be switched from an upper one item to a lower one item. After users have completed the switch of function desired, users may depress a confirmation key to complete the selection operations.

Although the four directional pushbuttons allow users to make switch or selection on the display screen, the operation is quite complicated and not convenient. Users often find it difficult to control the selection function on the viewing window.

SUMMARY OF THE INVENTION

The primary object of the invention is to provide an improved switch that allows users to push or depress for switching various selection function on the viewing window.

Another object of the invention is to provide a moving buffer effect in the switch to give users a touch sense when the button key is moving to increase operation touch feeling.

A further object of the invention is to reduce malfunction of the mechanism and increase control accuracy.

To achieve the foregoing objects, the switch of the invention consists of a seat, a button key, a first elastic element, a second elastic element, and a cap. Users can operate by pushing or depressing to control switching or selection of various function with more operation touch sense.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
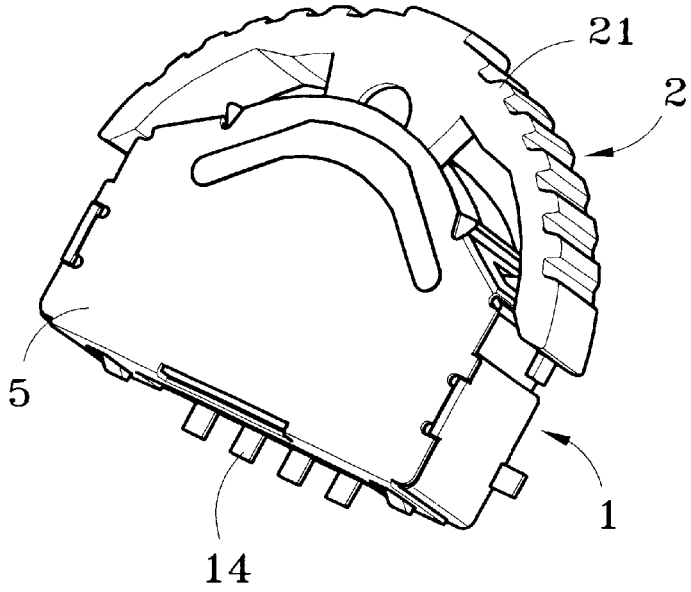
FIG. 1 is a perspective view of the switch of the invention.
Figure 2B:
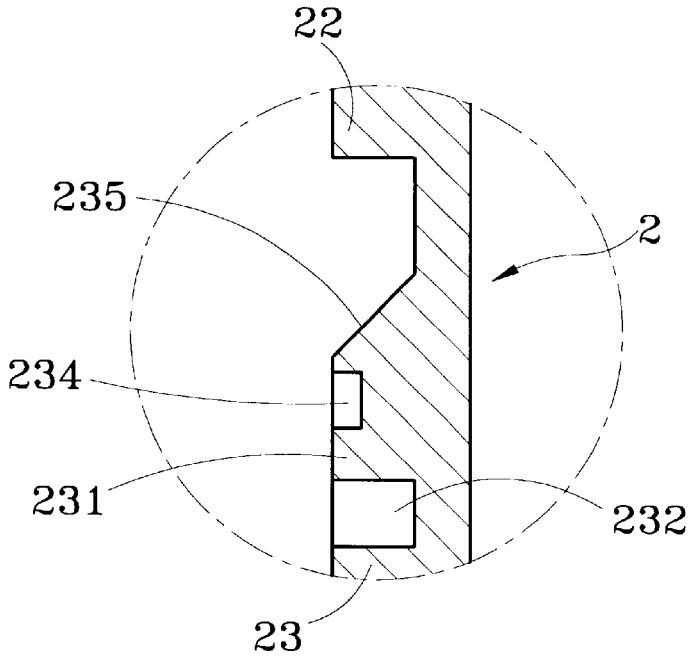
FIG. 2B is a fragmentary sectional view of a button key according to FIG. 2A.
Figure 2A:
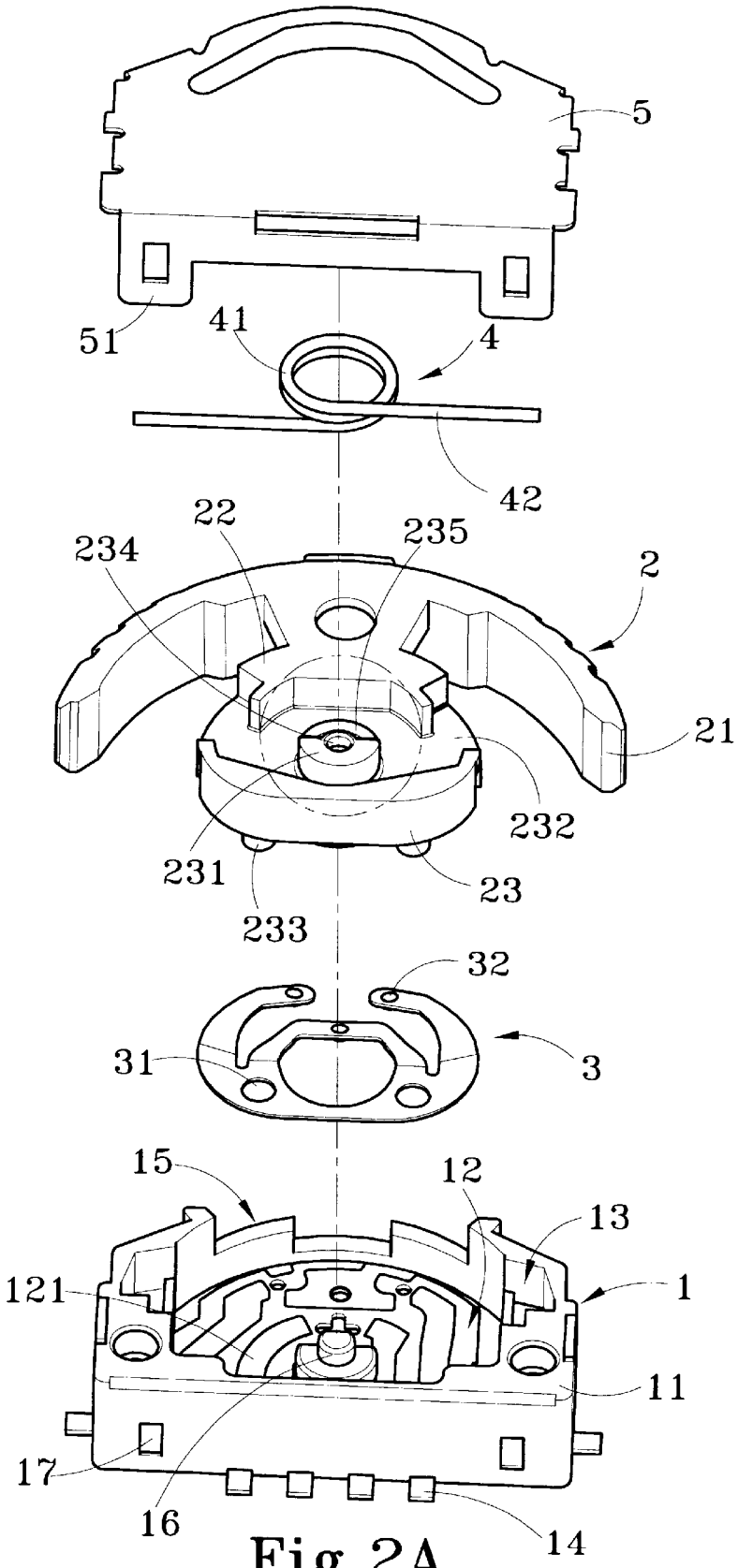
FIG. 2A is an exploded view of the invention according to FIG. 1.

Referring to FIGS. 1, 2A and 2B, 3 for an embodiment of the invention, the improved switch of the invention includes a seat 1, a button key 2, a first elastic element 3, a second elastic element 4 and a cap 5. The switch offers users pushing or depressing operations to control switching or selection of various function. The operation may be done with more touch sense.

The seat 1 has a thick section 11 which has a first housing section 12 and a second housing section 13. The first housing section 12 has a bottom side with conductive circuits 121 located thereon. The conductive circuits 121 connect legs 14 located on one end of the thick section 11 to form a power supply input and an output of control signals. The thick section 11 further has an operating space 15 corresponding to the first housing section 12 to allow the button key 2 operating therein. In the first housing section 12, there is a spindle 16 to pivotally couple with the button key 2. The thick section 11 also has a latch section 17 located on the bottom thereof.

The button key 2 has an arched key cap 21 which connects a neck 22. The neck 22 connects a rotary section 23 which has a pivotal section 231 jutting thereabove to pivotally engage with the spindle 16. The pivotal section 231 has a peripheral rim to form an operating section 232, and an anchor bore 234 located in the center thereof. There is an arched slide section 235 located on one side of the anchor bore 234.

The first elastic element 3 has a pair of symmetrical anchor sections 31 which are mounted to jutting sections 233 located on the backside of the rotary section 23. The first elastic element 3 further is extended on two sides to form a pair of symmetrical contact ends 32. The contact ends 32 may be moved by turning the rotary section 23 to connect circuits located in the first housing section 12 for generating a signal output corresponding to the operation of the button key 2.

The second elastic element 4 is located above the operating section 232, and has a winding section 41 which is located on the outer rim of the pivotal section 231. The winding section 41 has two free ends 42 pivotally connecting the second housing section 13.

The cap 5 is sealed to the surface of the thick section 11 and has a latch flange 51 engageable with the latch section 17.

Figure 3:
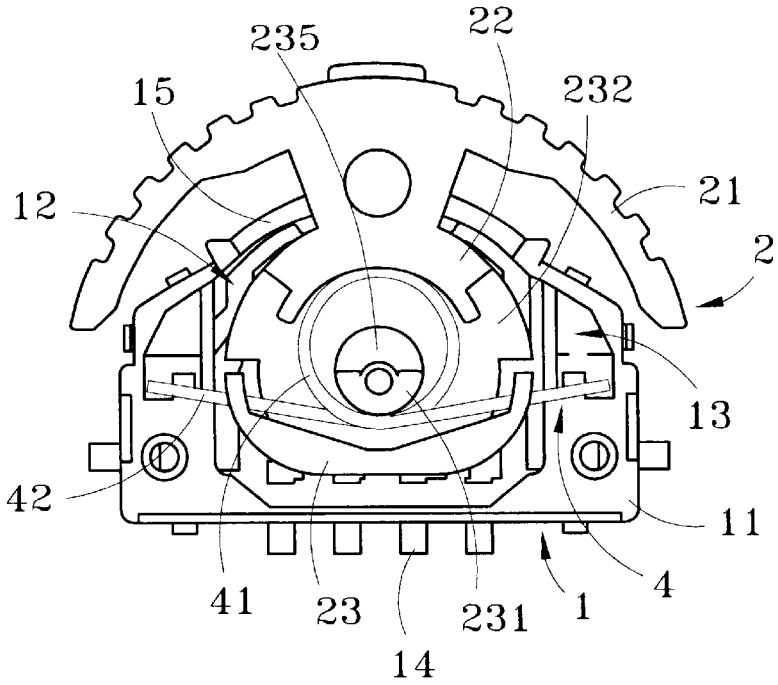
FIG. 3 is a schematic view of the invention, with the cap removed.
Figure 4:
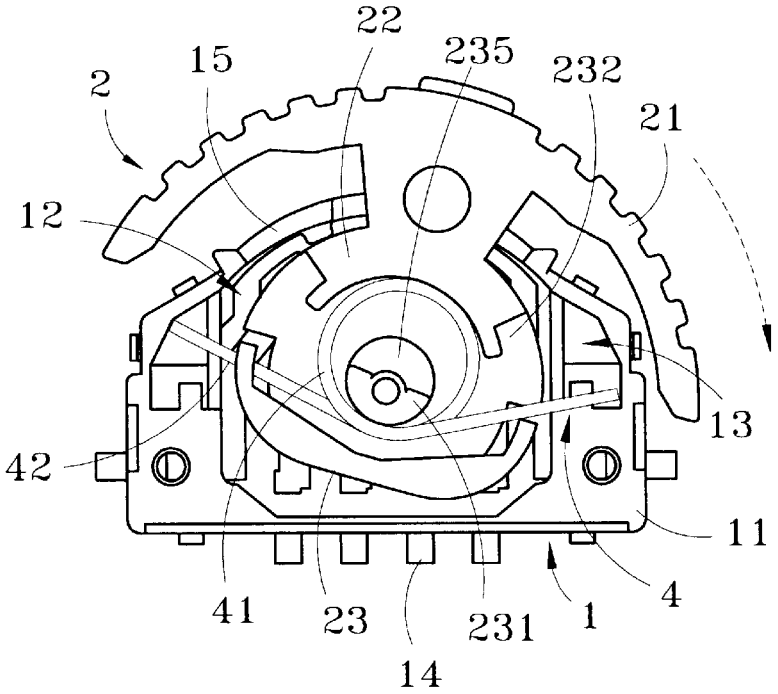
FIG. 4 is a schematic view of the invention according to FIG. 3, at an operation condition.

Referring to FIGS. 3 and 4 for the invention at an assembly and an using conditions, the button key 2, the first elastic element 3 and the second elastic element 4 are mounted to the seat 1. When the key cap 21 of the button key 2 is pushed forwards or rearwards by an external force, the neck 22 will be moved in the operating space 15 of the seat 1, and the rotary section 23 will be turned to allow the free ends 42 of the second elastic element 4 moving slowly into the second housing section 13 to contact the side wall of the second housing section 13 (to generate a buffer effect). In the mean time, the contact ends 32 of the first elastic element 3 mounted to the back side of the rotary section 23 connects the circuits located in the first housing section 12 to generate an electric signal output for controlling selection or function switching operations displayed on the viewing window.

When the rotary section 23 is turning, the free ends 42 of the second elastic element 4 move into the second housing section 13 and contact the side walls of the second housing section 13 slowly, users may sense a touch feeling of the movement of the button key 2 and can perform operations with more secured feeling.

Figure 5:
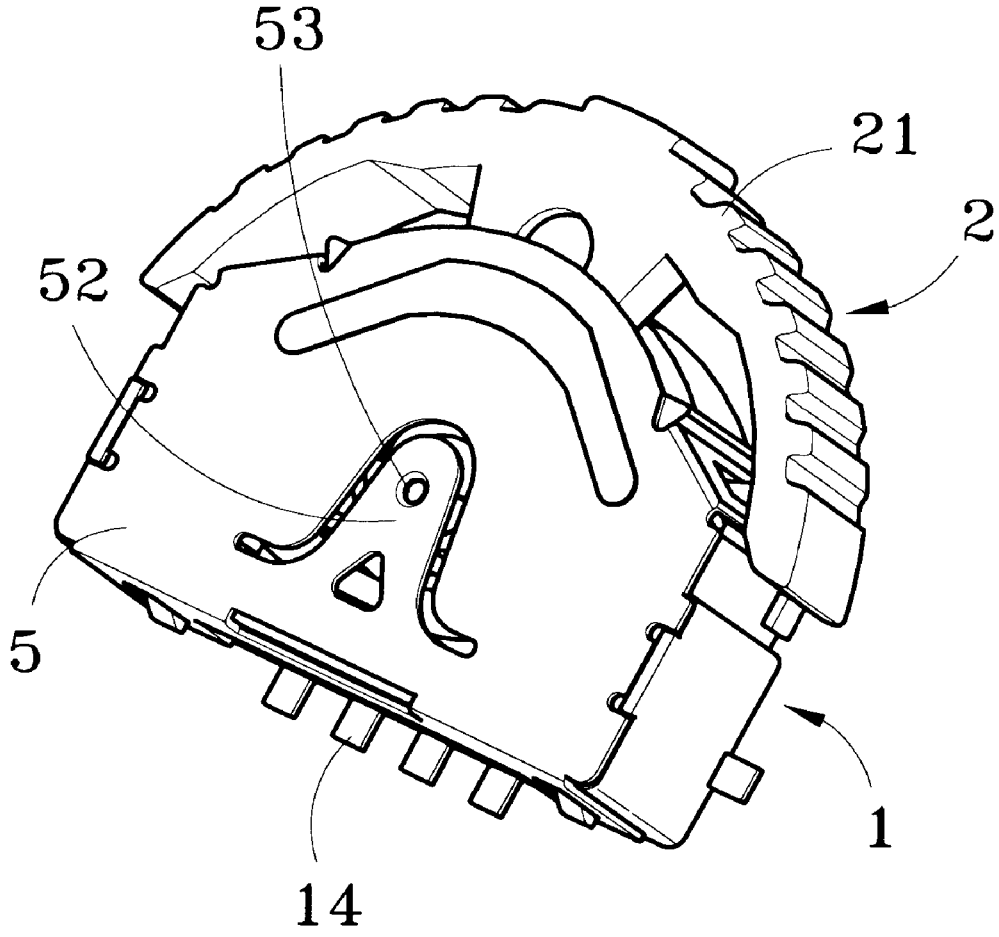
FIG. 5 is a perspective view of another embodiment of the invention.

Referring to FIG. 5 for another embodiment of the invention that is largely like the one shown in FIG. 1, the main difference is that the cap 5 has an additional elastic section

52 which has a bulged point 53 located thereon and pointing to another side of the cap 5. When the elastic section 52 is depressed upon the pivotal section 231, the bulged point 53 will be positioned in the anchor bore 234. Hence when users depress the button key 2, the bulged point 53 will be moved and slid from the anchor bore 234 to the slide section 235 to generate a click sound so that users may have a secured sense that the switch is functioning properly.

Figure 6:
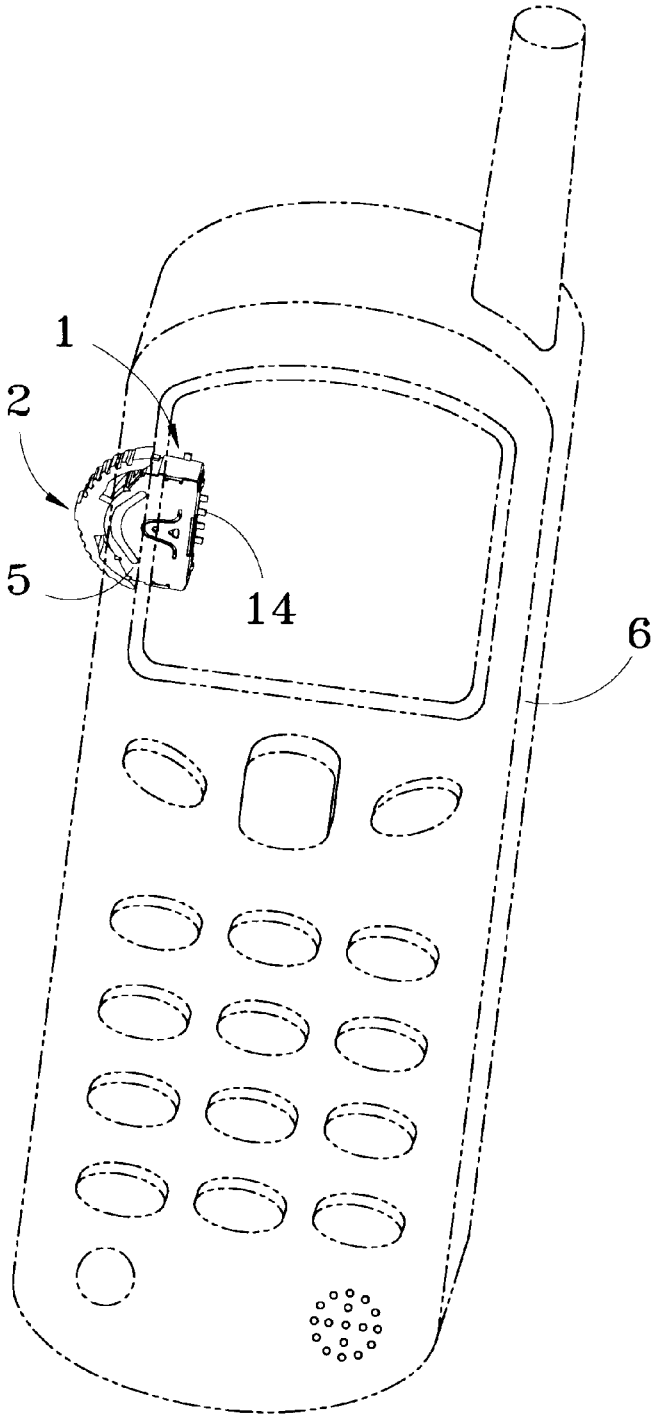
FIG. 6 is a pictorial view of another embodiment of the invention.

FIG. 6 illustrates yet another embodiment the invention adapted for use on a mobile phone. The switch of the invention may be adapted on keyboards, notebook computers, or handheld computers, or a mobile phone 6. When the button key 2 is pushed by an external force, function selection or switching operations appeared in the viewing window may be performed as desired.

What is claimed is:

1. An improved switch for generating an electric signal output to control desired function switching or selection operations, comprising:

a seat having a thick section which includes a first housing section and a second housing section, and an operating space corresponding to the first housing section, the first housing section having a spindle located therein;

a button key located in the first housing section having an arched key cap which connects a neck, the neck connecting a rotary section which has a pivotal section extending thereabove to pivotally engage with the spindle, the pivotal section having a peripheral rim to form an operating section;

a first elastic element located on one side of the rotary section having a pair of symmetrical anchor sections which are mounted to jutting sections located on a back side of the rotary section, and having two sides extending to form a pair of symmetrical contact ends;

a second elastic element located on the operating section having a winding section which is located on an outer rim of the pivotal section, the winding section having two free ends pivotally connecting the second housing section; and a cap being sealed to the surface of the thick section of the seat;

wherein the button key is movable forwards or rearwards, or depressable downwards by an external force for turning the rotary section such that the free ends of the second elastic element are moved slowly into the second housing section and contact side walls of the second housing section to allow users having a touching sense of button key movement to increase operation touch feeling.

2. The improved switch of claim 1, wherein the first housing section has a bottom side with conductive circuits located thereon, the conductive circuits connecting legs located on the thick section to form a power supply input and an output of control signals.

3. The improved switch of claim 1, wherein the thick section has a latch section located on the bottom thereof.

4. The improved switch of claim 1, wherein the pivotal section has an anchor bore located in the center thereof, and an arched slide section located on one side of the anchor bore.

5. The improved switch of claim 1, wherein the cap has a latch flange engageable with the latch section.

6. The improved switch of claim 1, wherein the cap has an elastic section which has a bulged point located thereon and pointing to another side of the cap, the elastic section being depressable upon the pivotal section for moving the bulged point into the anchor bore.

* * * * *